United States Patent [19]

Jones

[11] Patent Number: 4,930,483

[45] Date of Patent: Jun. 5, 1990

[54] FUEL TREATMENT DEVICE

[76] Inventor: Wallace R. Jones, 5702 Trails Edge Ct., Arlington, Tex. 76017

[21] Appl. No.: 392,484

[22] Filed: Aug. 11, 1989

[51] Int. Cl.[5] ..... F02M 33/00

[52] U.S. Cl. ..... 123/538

[58] Field of Search ..... 123/536, 537, 538, 1 A, 123/3

[56] References Cited

U.S. PATENT DOCUMENTS

| | | | |
|---|---|---|---|
| 3,597,668 | 8/1971 | Yoshimine | 123/538 |
| 4,050,426 | 9/1977 | Sanderson | 123/538 |
| 4,267,976 | 5/1981 | Chatwin | 123/538 |
| 4,373,494 | 2/1983 | McMahon | 123/538 |
| 4,429,665 | 2/1984 | Brown | 123/3 |
| 4,515,133 | 5/1985 | Roman | 123/538 |

*Primary Examiner*—Willis R. Wolfe
*Assistant Examiner*—M. Macy
*Attorney, Agent, or Firm*—Morgan L. Crow

[57] ABSTRACT

There is disclosed a fuel treatment device for internal combustion engines comprising a housing having an inlet and an exit, a first metallic core in the housing, a second metallic housing in the housing and adapted to form a non-linear flow path in cooperation with the first metallic core, wherein the first metallic core comprises aluminum, and wherein the second metallic housing comprises an alloy of aluminum, copper, tin, zinc, iron, nickel, lead, sulfur and phosphorus.

7 Claims, 1 Drawing Sheet

FUEL TREATMENT DEVICE

BACKGROUND OF THE INVENTION

The prior art teaches that flowing liquids may be treated or altered by being exposed to a sacrificial metal which is anodic to the system container. Different metals of the electromotive series placed in contact to each other in an electrolytic solution permits the flow of electrolytic current between a metal anode and a metal cathode. Chemical oxidation of the anode produces the current.

In U.S. Pat. No. 3,486,999, Leonard F. Craft discloses sacrificial metal anodes to prevent scale formation in water systems. An anode may be consumed over a period of time in chemical reaction with a liquid in preference to the more noble metal, as in pipes, which is to be protected.

In U.S. Pat. No. 3,448,034, Leonard F. Craft discloses a non-sacrificial metal anode to stabilize liquids such as produced from oil and water wells and prevent precipitation of solids in the flow tubes.

In U.S. Pat. No. 3,597,668, Kualo Yoshimine teaches the use of a fuel treatment device for internal combustion engines to electrostatically charge the fuel through frictional contact with a rolled sheet metal or mesh core treated with a semiconductor film.

In U.S. Pat. No. 4,475,484, Antonio Filho teaches the use of catalyst in a reaction chamber through which fuel for an internal combustion engine is flowed. The reaction chamber is heated by circulation of gasses through a heat exchanger in the engine exhaust manifold and a heat exchanger surrounding the reaction chamber.

Alternation of flowing hydrocarbons in the presence of a metal alloy is usually attributed to polarization of the molecules, that is, a change in the electrostatic charge of the hydrocarbon molecules. Claud W. Walker in U.S. Pat. No. 4,715,325 teaches the use of a crystalline alloy for treating the fuel for an internal combustionen gine to achieve reduced pollution, increased performance, cleaner running combustion chamber, and cleaner fuel flow apparatus downstream of the crystalline alloy. An alloy used by Walker consisted of copper, zinc, nickel, lead and small amounts of iron, antimony, sulfur, and manganese. Walker taught the use of an alloy of similar to that used by Craft in U.S. Pat. No. 3,448,034.

In U.S. Pat. No. 4,429,665, Bill H. Brown teaches the use of a fuel treatment device containing an alloy bar made of nickel, zinc, copper, tin and silver. Ridges in the bar promote turbulent flow of the fuel.

Various theories have been advanced to explain benefits gained by flowing internal combustion engine fuel past such a crystalline alloy. The inventor believes the benefits can be explained by the electromotive potential imposed on molecules in the fuel flow. The greater electromotive potential can be achieved by first causing turbulent flow of the fuel in the presence of a crystalline alloy and another metal, aluminum, enhances the electrical effect on the fuel molecules. Also, it is very important to utilize the fuel before the electrical charge dissipates over a period of time, and passage through excessive length of fuel line to carry the fuel to the engine. Electrical insulation of the treated fuel from the untreated fuel is important. The apparatus as installed for the treatment alloy metals and fuel line should have a break in electrical conductivity between the treated and untreated fuel. This insulation can be provided by use of a nonconductive housing or the use of a conductive housing in combination with a nonconductive segment in the fuel line such as a section of rubber hose as part of the fuel line, preferably upstream of the apparatus.

The Federal Government and most states now have legislation requiring an increase in fuel efficiency in automobiles, and/or reductions in offensive exhaust emissions from automobiles and trucks.

Automobile and truck tests have been conducted to prove the benefit of my invention, which was first developed in an attempt to increase fuel efficiency, but proved during lab tests to reduce both hydrocarbon and carbon monoxide emissions from both gasoline and diesel engines. In each lab test emissions have been reduced, and fuel milage per gallon has increased up to 17%.

Therefore there has been a long felt need for a device which can treat automobile and truck fuels to increase the efficiency of the vehicles in miles per gallon, and in reduced emissions of offensive substances from the vehicles.

SUMMARY OF THE INVENTION

In the instant invention, an electrically insulated treatment chamber is placed in the fuel line in close proximity to the engine. A treatment core of at least two metallic members is placed in the treatment chamber, and turbulent flow caused by non linear flow of the fuel in the presence of the metallic core is encouraged to achieve treatment of the gasoline or diesel fuel. One portion of the treatment core is made of aluminium, and the other portion is made of an alloy comprising aluminum, copper, tin, zinc, antimony, nickel, lead, sulfur and phosphorus, with trace amounts of manganese, iron and silicon.

The turbulence of the fuel flow achieves more complete treatment of the fuel by causing more intimate contact of more fuel molecules with the metallic treatment core.

An object of my invention is to provide apparatus to treat fuel for internal combustion engines to achieve reduced emissions of hydrocarbons and carbon monoxide.

Another object of my invention is to provide apparatus to treat fuel for internal combustion engines to provide greater work per unit of fuel consumed. One way to measure this increase in efficiency is by increased miles per gallon of a vehicle.

A still further object of my invention is to provide apparatus to treat fuel for internal combustion engines which will result in reduced deposits in the fuel line, carburetor or injectors.

These and other objects and benefits will become apparent to those skilled in the art upon reading the following detailed specification and referring to the accompanying drawings.

DETAILED DESCRIPTION OF THE PREFERRED EMBODIMENT

Figure 1:
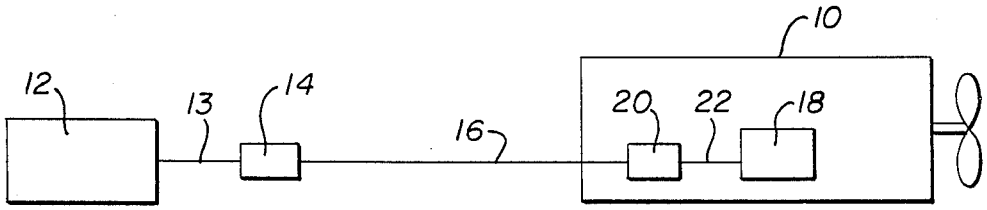
FIG. 1 is a schematic drawing of an internal combustion engine with the fuel tank and fuel lines according the present invention.

Referring to FIG. 1, there is illustrated a schematic drawing of an internal combustion engine with the fuel tank and fuel lines according the present invention. An engine 10 is supplied with fuel from a tank 12. A section of fuel line 13 supplies fuel to a fuel pump 14 which pressures the fuel to cause flow of the fuel to the engine 10 through a section of the fuel line 16. The engine 10 may be of the gasoline or diesel type. On a gasoline engine, the fuel is supplied to the engine by device 18 which may be a carburetor or single or multiple injectors. On a diesel engine, unit 18 represents the fuel injectors. For the purposes of this specification, unit 18 will be referred to as a carburetor with the understanding that unit 18 also represents single or multiple fuel injectors for a gasoline or diesel engine. The treatment device 20 is installed in the fuel line so that the entire fuel flow passes through device 20 as will be described in detail below. A section of fuel line 22 carries the fuel to the carburetor 18.

Figure 2:
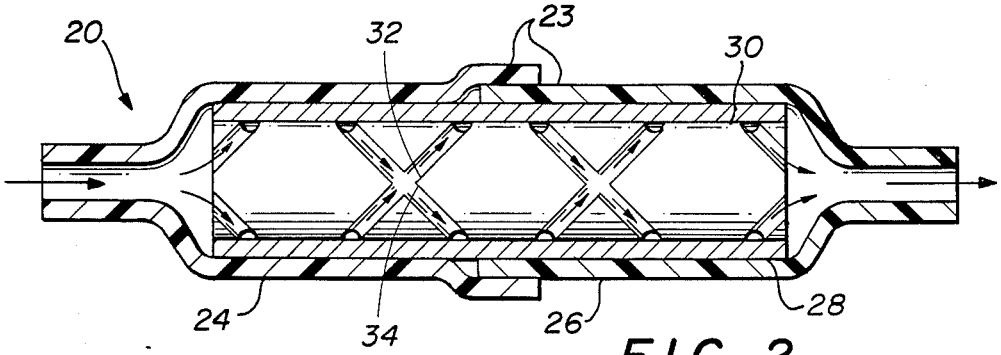
FIG. 2 is a partial cross section view of the preferred embodiment of the present invention.

Referring now to FIG. 2, the preferred embodiment of the fuel treatment device 20 is illustrated. A plastic housing 23 is made up of ends 24 and 26 connected by sonic welding or adhesive at the joint by using materials, procedures, and tecniques well known in the industry. Housing end 24 is provided with an inlet to admit fuel and end 26 is connected to with an outlet or exit connected to fuel line 22 as described above. An aluminum tube 28 is fitted inside the housing 23 to substantially prevent flow of fuel outside tube 28. A metallic core 30 is fitted inside the tube 28. The core 30 is formed with a helical groove 32 in one direction and another helical groove 34 which spirals in the opposite direction. The fuel flows through the sprial grooves 32 and 34, being exposed to the aluminum tube 28 and the metal core 30, and causing turbulence at the plurality of intersections formed by the spiral grooves 32 and 34. The grooves 32 and 34 also promote turbulence by surface roughness in the surfaces of these grooves. The turbulent flow is promoted by providing non-linear flow of the fuel through the apparatus and by surface roughness of the surfaces forming the flow passage.

The metallic core 30 interacts with the aluminum tube 28 to accomplish the treatment of the fuel. The composition of the core 30 with the preferred analaysis and the preferred ranges of various elements are as follows:

| | Preffered Percent Range | Preferred Percent by Weight |
|---|---|---|
| Aluminum | 1.00-3.00 | 2.00 |
| Copper | 50.00-58.00 | 54.00 |
| Tin | 1.50-3.00 | 2.00 |
| Zinc | 17.00-25.00 | 20.00 |
| Iron | 0.00-0.01 | 0.01 |
| Antimony | 0.00-0.35 | 0.00 |
| Nickel | 11.00-14.00 | 12.00 |
| Lead | 8.00-11.00 | 9.00 |
| Sulfur | 0.05-1.05 | 0.10 |
| Phosphorous | 0.05-1.00 | 0.88 |
| Manganese | 0.00-0.05 | 0.00 |
| Silicon | 0.01-0.05 | 0.02 |

It should be appreciated that the aluminum, copper, tin, zinc, iron, antimony, nickel and lead are the essential elements for this invention. Sulfur, phosphorus, manganese and silicon are residual trace elements which will be present in available alloys, but play no significant part in the operation of this invention.

Figure 3:
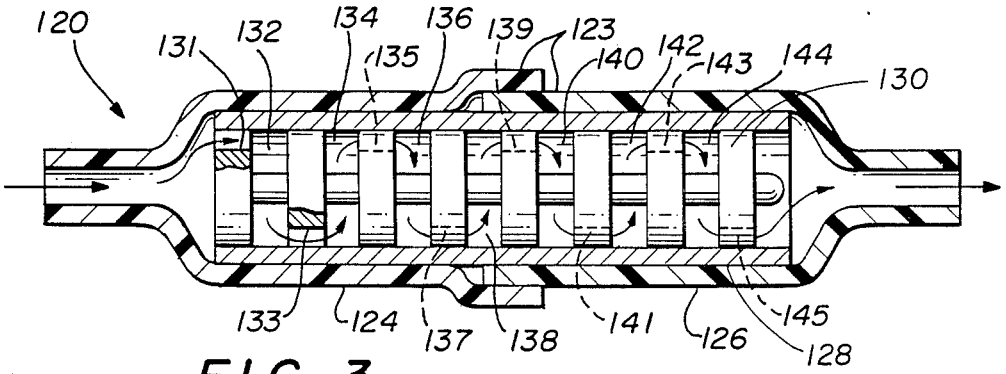
FIG. 3 is a partial cross section view of an alternate embodiment.

Referring now to FIG. 3, an alternate embodiment is illustrated. A plastic housing 123 is made up of ends 124 and 126 connected by sonic welding or adhesive at the joint as described above. A tubular aluminum tube 128 is fitted inside the housing 123 to substantially prevent flow of fuel outside tube 128. A metallic core 130 is fitted inside the tube 128. The core 130 is formed with circular grooves 132, 134, 136, 138, 140, 142 and 144. The fuel flows through the axial grooves 131, 133, 135, 137, 139, 141, 143 and 145, the grooves being positioned in alternating non-linear pattern to cause turbulence in the flow due to the many changes in direction. The fuel is exposed to the aluminum tube 128 and the metal core 130, and causing turbulence at the multiple points where flow directions change. The circular and axial grooves also promote turbulence by surface roughness in the surfaces of these grooves.

The metallic core 130 interacts with the aluminum tube 128 to accomplish the treatment of the fuel. The composition of the core 130 with the preferred analysis and the preferred ranges of various elements are the same as described hereinbefore.

Figure 4:
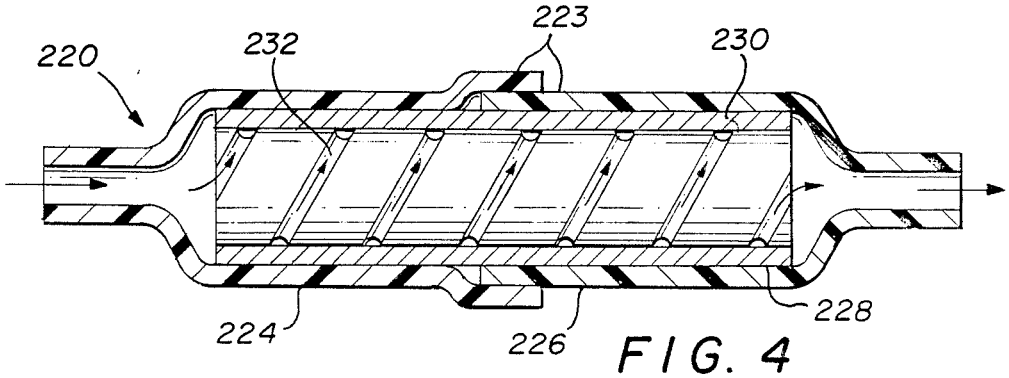
FIG. 4 is a partial cross section view of another alternate embodiment.

Referring now to FIG. 4, a still further alternate embodiment of the fuel treatment chamber 220 is illustrated. A plastic housing 223 is made up of ends 224 and 226 connected by sonic welding or adhesive at the joint by using materials, procedures, and techniques as described hereinbefore. A tubular aluminum tube 228 is fitted inside the housing 223 to substantially prevent flow of fuel outside tube 228. A metallic core 230 is fitted inside the tube 228. The core 230 is formed with a helical groove 232. The fuel flows through the spiral groove 232 being exposed to the aluminum tube 228 and the metal core 230. The groove 232 promotes turbulence by surface roughness in the surfaces of the groove. The turbulent flow is also promoted by providing non-linear flow of the fuel through the apparatus.

The metallic core 230 interacts with the aluminum tube 228 to accomplish the treatment of the fuel. The composition of the core 230 with the preferred analysis and the prferred ranges of various elements are the same as described hereinbefore.

Referring again to FIGS. 1 and 2, this invention is utilized by fitting a copper base metallic core 30 with an aluminum tube 28 in a housing 23 electrically insulating the upstream fuel line 16 from the downstream fuel line 22. The housing 23 is placed in a fuel line for an internal combustion engine 10. The housing 23 should be placed in close proximity to the carburetor 18 so the electrical charge imparted to the fuel molecules will have a minimum of time to dissipate, and will be exposed to a minimum length of electrically conductive fuel line. My experiments indicate the fuel line 22 should preferably be no longer than approximately 18 inches to achieve maximum benefit from my invention. The fuel line should be no longer than 24 inches to gain the benefit from my invention. A metallic and therefore electrically conductive housing can be utilized by using a rubber or other nonconductive connection in the fuel line, preferably at the inlet to the treatment advice 20, but upstream of the device 20.

The treatment device of this invention imparts an electrostatic charge to the fuel by exposing the fuel to two different metallic components described above in a non-linear flow path, causing as much turbulence in the flow of the fuel as is commensurate with an appropriate pressure drop in the fuel from the inlet to the outlet of the treatment device.

A number of tests have been conducted to determine the effectiveness of this invention.

DIESEL ENGINE EMMISSION TEST:

Test Vehicle

1986 Freightliner 350 turbo diesel truck with 421,000 miles.

| Device | Hydrocarbon ppm | Carbon Monoxide % |
|---|---|---|
| No | 139.61 | .061 |
| Yes | 82.44 | .042 |

Test Vehicle

1986 Chrysler 5th Avenue 318 V8 with 48797 miles at idle speed.

| Device | Hydrocarbon ppm | Carbon Monoxide % |
|---|---|---|
| No | 255 | 1.94 |
| Yes | 39 | 0.04 |

Test Vehicle

1987 Oldsmobile 98 with 350 engine, 41,553 miles at 55 miles per hour.

| Device | Hydrocarbon ppm | Carbon Monoxide % |
|---|---|---|
| No | 134 | 1.49 |
| Yes | 81 | .052 |

Test Vehicle

1988 Plymouth "K"4 cylinder 2.2 liter engine with 23,883 miles at idle speed.

| Device | Hydrocarbon ppm | Carbon Monoxide % |
|---|---|---|
| No | 647 | 1.19 |
| Yes | 45 | 0.04 |

Although embodiments of this invention have been illustrated in the accompanying drawings, and described in the foregoing Detailed Description of the Preferred Embodiment it will be understood that the invention is not limited to the embodiments disclosed, but is capable of numerous rearrangements, modifications and substitution of parts without departing from the spirit and scope of the invention.

I claim:

1. A fuel treatment device for internal combustion engines comprising a housing having an inlet and an exit, a metallic element in said housing, a metallic core in said housing and adapted to form a non-linear flow path in cooperation with said metallic element, wherein said metallic element comprises aluminum, and wherein said metallic core comprises an alloy of aluminum, copper, tin, zinc, iron, nickel, lead, sulfur and phosphorus.

2. Apparatus according to claim 1 wherein said metallic core and said metallic element are electrically insulated from said inlet.

3. Apparatus according to claim 1 wherein said outlet is located within substantially 24 inches from a carburetor.

4. Apparatus according to claim 1 wherein said metallic core is tubular, and said metallic core is positioned internally of said metallic element.

5. Apparatus according to claim 1 wherein said metallic element and said metallic core form a spiral flow path.

6. Apparatus according to claim 1 wherein said metallic element and said metallic core form a first spiral flow path in one direction and a second spiral flow path in the other direction whereby said first and second flow paths form a plurality of flow path intersections.

7. Apparatus according to claim 1 wherein said outlet is located within substantially 18 inches from a carburetor.

* * * * *